United States Patent [19]

Seidler

[11] 3,989,392

[45] Nov. 2, 1976

[54] DISPENSING DEVICE

[75] Inventor: David Seidler, Forest Hills, N.Y.

[73] Assignee: Revlon, Inc., New York, N.Y.

[22] Filed: Jan. 21, 1975

[21] Appl. No.: 542,833

[52] U.S. Cl. ..... 401/66; 401/84

[51] Int. Cl.[2] ..... B43K 21/88

[58] Field of Search ..... 401/66, 84, 82, 78, 401/80

[56] References Cited

UNITED STATES PATENTS

| | | | |
|---|---|---|---|
| 1,997,496 | 4/1935 | Nagy | 401/66 |
| 2,293,343 | 8/1942 | Jacobs | 401/84 |
| 2,484,555 | 10/1949 | Comstock | 401/66 X |
| 2,589,000 | 3/1952 | Vani | 401/82 X |
| 3,495,292 | 2/1970 | Giba et al. | 401/84 X |
| 3,728,034 | 4/1973 | Winter | 401/66 |

FOREIGN PATENTS OR APPLICATIONS

| | | | |
|---|---|---|---|
| 993,469 | 7/1951 | France | 401/82 |

*Primary Examiner*—Lawrence Charles
*Attorney, Agent, or Firm*—Leon E. Tenenbaum

[57] ABSTRACT

A device for dispensing material in stick form and retracting the material into the device when not in use, which is constructed of inexpensive materials and is readily fabricated, comprising a housing, a holder for the material being dispensed, means for moving the holder, and means for preventing the material from being pushed back into the housing when being applied.

2 Claims, 9 Drawing Figures

DISPENSING DEVICE

The present invention relates to dispensing devices and more particularly to a dispensing device for applying cosmetics such as eye make-up, lipsticks, rouges and the like, wherein the cosmetic being applied or an applicator for applying the cosmetic is held within the device and projected therefrom when used.

Numerous devices exist for dispensing from a holder materials such as cosmetics in stick form by moving the cosmetic stick out of the holder or housing and exposing as much of the material as is needed for use and then withdrawing the stick into the holder by retraction when not in use. Such devices usually consist of an outer tubular shell or housing, a movable holder for the cosmetic stick within the shell, and means for axially moving the holder within the shell. Such means usually employ movement within a helix or a linear movement along a ratchet. All of these prior art devices are relatively expensive to produce, requiring expensive tooling and expensive fabricating procedures.

It is accordingly an object of this invention to provide a device for dispensing in stick form cosmetics and other materials, which is inexpensive to produce, requiring inexpensive tooling and inexpensive fabricating procedures.

It is another object of this invention to provide a device for dispensing cosmetics in stick form, in which the dispensing mechanism is constructed substantially of plastics.

It is a further object of this invention to provide a retractable dispensing mechanism for dispensing cosmetics which will resist normal pressures used in applying cosmetics and not be pushed back into the housing in which the mechanism and cosmetic are contained.

It is still another object of this invention to provide a refillable dispensing device for cosmetics.

It is still a further object of this invention to provide a dispensing device for cosmetics in which the cosmetic refill may be replaced by an applicator for cosmetics, such as a brush or dabber.

It is still another object of this invention to provide a dispensing device for cosmetics which may be readily assembled.

Other features and advantages of this invention will be apparent from the specification and claims when considered in connection with the accompanying drawings in which:

Figure 1:
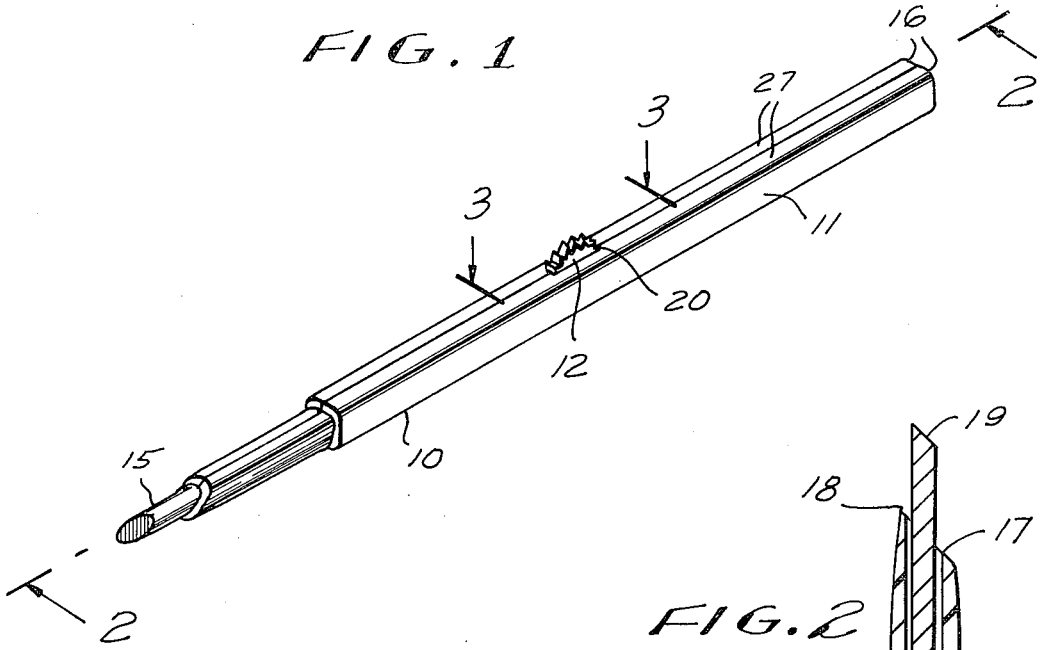
FIG. 1 is a perspective view of a cosmetic dispensing device of the present invention showing the exposed cosmetic stick.
Figure 2:
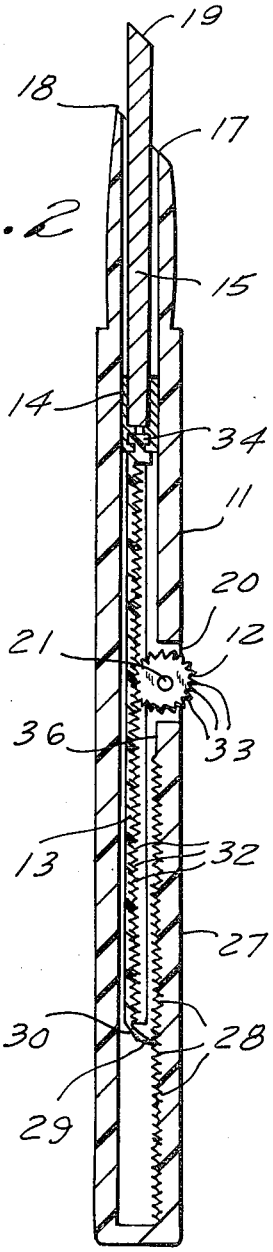
FIG. 2 is a longitudinal cross-sectional view taken along the line 2—2 of FIG. 1.
Figure 3:
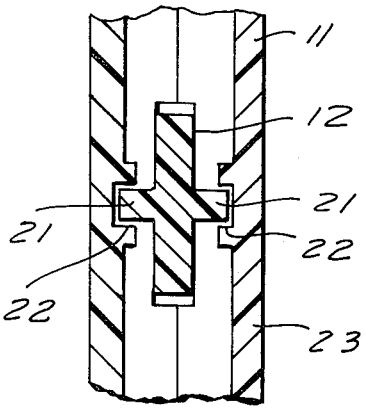
FIG. 3 is a transverse cross-sectional view taken substantially along the line 3—3 of FIG. 1.
Figure 4:
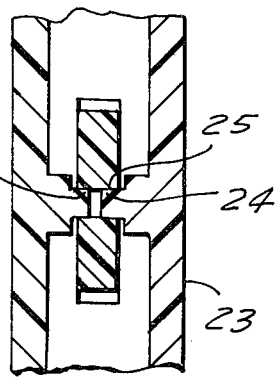
FIG. 4 is a view similar to FIG. 3 showing different means for holding the gear wheel in the housing.
Figure 5:
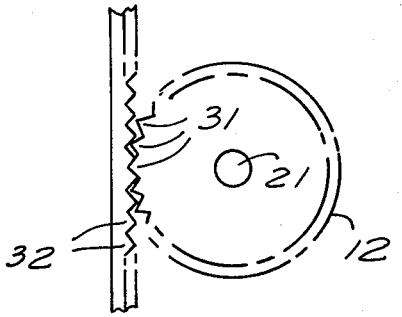
FIG. 5 is an enlargement of the propelling mechanism shown in FIG. 2.
Figure 7:
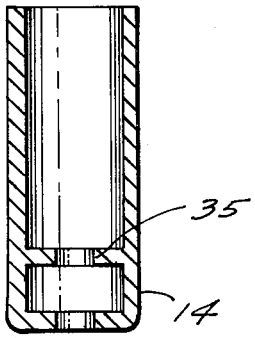
FIG. 7 is an enlarged longitudinal sectional view of the cup shown in FIG. 2.
Figure 6:
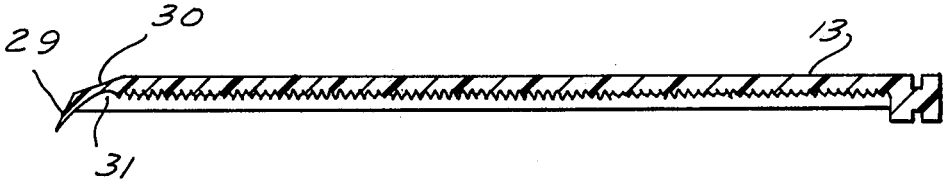
FIG. 6 is an enlargement of the lower part of the elevator shown in FIG. 2.

Referring again to the drawings, a dispensing device constituting one embodiment of the present invention generally designed 10, includes a housing 11 which houses a gear wheel 12 which houses a gear wheel 12 which engages an elevator 13 which fits into a holder 14 holding the material 15 being dispensed. The housing is formed of two halves 16 which are mirror images of each other. The end opening 17 of the housing is preferably cut at an angle 18 to enable the end 19 of the material being applied to be similarly angled by rubbing the end of the material outside the opening on a surface. The housing contains a lateral opening 20 in which the gear wheel is held by pins 21 which fit into holes 22 in the walls 23 of the housing. The gear wheel may also be held by pins 24 which protrude from the walls of the housing into holes 25 in the gear wheel. The inner surface 26 the lower portion of the side 27 of the housing through which the gear wheel is inserted is provided with a series of rack teeth 28 which is in a longitudinal direction. The rack teeth engage a pawl 29 which is at the lower end of the elevator 13 and integral with the elevator to provide a ratchet mechanism. The bottom portion 30 of the elevator is preferably angled in the direction of the pawl, and in the elevator just above the pawl there is preferably provided a cut-out 31 which together with angled portion of the elevator provide a spring-like effect to the pawl. The pawl is movable in relation to the angle it makes with the axis of the elevator, and bends away from the direction of the movement of the elevator. The elevator is provided with a longitudinal series of rack teeth 32 which engage the teeth 33 of the gear wheel. The upper end portion 34 of the elevator fits into the holder 14 for the material being dispensed, in a bayonet-type fitting 35 which serves to prevent any rotation and consequent displacement of the elevator. The holder can be readily removed from the elevator by pushing it outside the housing and then pulling it off, and can be replaced by another holder of the same structure. Instead of holding the material to be dispensed, the holder may hold a dispensing implement such as a brush or dabber. This enables one to readily replace the material being dispensed by refills when needed. When the gear wheel is turned it will propel the elevator either up or down as desired. When the elevator moves up the pawl will come into contact with a stop 36 formed by an inward extension of the wall 23 of the housing, which serves to prevent further upward movement. When the gear wheel is turned to lower the elevator the pawl will press against the teeth 28 in the wall of the housing. The height and and angle of the teeth will determine the amount of force which has to be applied to the gear wheel to push the pawl downward, and this angle and height as well as the length of the pawl are so adjusted that while it is possible to move the elevator down by turning the gear wheel the pressure on the material being applied is not strong enough to push the pawl through the teeth 28, thus preventing slippage.

The housing, gear wheel, elevator and holder are constructed of plastic but, if desired, the holder may be constructed of metal. The dispensing device of this invention is readily assembled by placing the elevator in proper position in one of the halves of the housing, fitting the gear wheel into this housing half and then fitting on the other housing half at the same time fitting the gear wheel into this second half. The housing halves may then be heat sealed or, if preferred, a proper adhesive may be applied to edges of the halves before they are fitted together.

Figure 8:
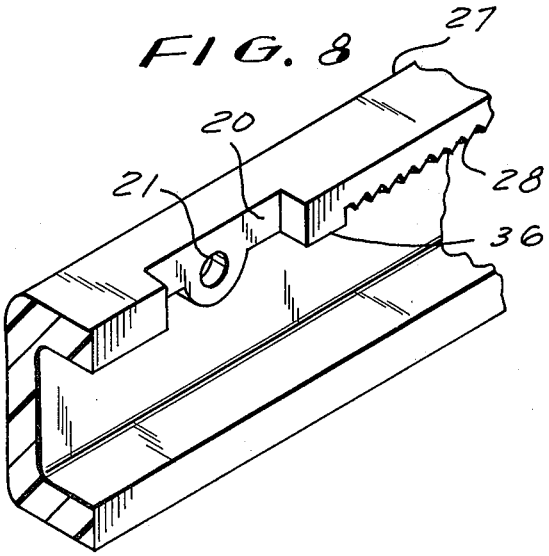
FIG. 8 is a perspective view of the internal structure of one of the halves of the housing.
Figure 9:
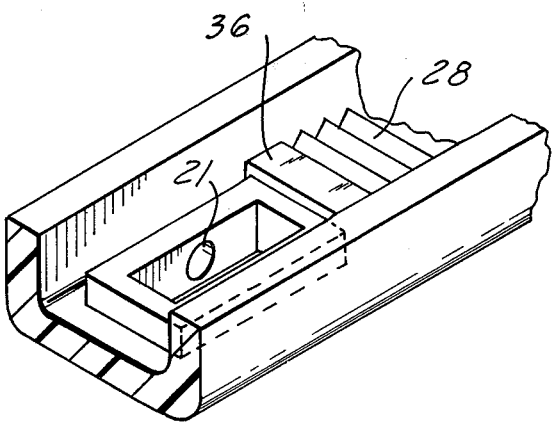
FIG. 9 is a perspective view of the internal structure of another type of housing.

Instead of the two halves of the housing shown in FIGS. 1 and 8, the housing may be constructed so that one of the sides has the lateral opening 20, the rack teeth 28, and the stop 36 as is shown in FIG. 9.

From the foregoing, the operation and construction of the dispensing device will be readily understood. Since numerous modifications and changes will readily occur to those skilled in the art, it is not intended to limit the invention to the exact construction shown and described herein, and accordingly all suitable modifications and equivalents which may be resorted to are considered to fall within the scope of this invention.

I claim:

1. A device for dispensing material in stick form and retracting the material into the device when not in use, comprising a housing which houses a gear wheel held in a lateral opening in one side of the housing, said gear wheel being provided with teeth which engage rack teeth on an elevator fitting into a cup holding the material being dispensed, said elevator and cup being retained inside the housing and being separable; the inner surface of the side of the housing having the lateral opening being provided with a series of rack teeth in a longitudinal direction, said rack teeth engaging a pawl extending from and in integral construction with the elevator on the same side of the elevator as its rack teeth, the end of the elevator from which the pawl extends being angled in the direction of the pawl and containing a cutout before the pawl on the same side as the pawl said pawl being movable so that it bends in a direction opposite to the movement of the elevator.

2. A device according to claim 1 wherein the inner wall of the housing having the series of rack teeth is provided with an inward extension which serves to contact the pawl and stop the elevator as it moves upward.

* * * * *